United States Patent [19]

Swindler

[11] Patent Number: 4,520,240

[45] Date of Patent: May 28, 1985

[54] FOUR-WAY KEY SWITCH CONTROL MECHANISM

[75] Inventor: Dan E. Swindler, Round Rock, Tex.

[73] Assignee: Texas Instruments Incorporated, Dallas, Tex.

[21] Appl. No.: 556,872

[22] Filed: Dec. 1, 1983

[51] Int. Cl.[3] ..... G09F 9/30; H01H 3/00; H01H 19/00

[52] U.S. Cl. ..... 200/5 R; 200/18; 200/153 K; 200/339; 340/706

[58] Field of Search ..... 200/1 R, 5 R, 5 A, 6 R, 200/6 A, 6 B, 6 BA, 6 BB, 6 C, 17 R, 18, 153 K, 315, 339; 340/706, 709, 711, 712

[56] References Cited

U.S. PATENT DOCUMENTS

| | | | |
|---|---|---|---|
| 3,383,477 | 5/1968 | Swisher | 200/6 BB |
| 4,323,744 | 4/1982 | Sheridan et al. | 200/339 X |
| 4,401,864 | 8/1983 | Ichikawa | 200/6 B X |
| 4,428,649 | 1/1984 | Main et al. | 200/6 A |

*Primary Examiner*—J. R. Scott

*Attorney, Agent, or Firm*—René E. Grossman; Melvin Sharp; Leo N. Heiting

[57] ABSTRACT

A four-way integral switch mechanism allows activation of any one of four switches. This mechanism may be used to position a cursor on a display in both the vertical and horizontal directions where there is a need to control four separate switches to properly locate the cursor. The switch mechanism includes two switch toppers, one of which snaps into and pivots within the other along an axis in a first direction. These two switch toppers then snap into a base which provides a second pivot axis for the second topper which is 90 degrees from the first. The base may have guide pin holes for positioning it as well as the two switch toppers. A spring mechanism engages each of the four lower surfaces of the switch toppers. The switch toppers thereby form one integral whole providing control of four switches by sliding a finger in the direction that cursor movement is desired. Each key has only one degree of freedom, that of rotation, which gives the key a firm controlled feel.

6 Claims, 5 Drawing Figures

FOUR-WAY KEY SWITCH CONTROL MECHANISM

TECHNICAL FIELD OF THE INVENTION

This invention relates to a key switch assembly and more particularly to an integral key switch assembly capable of controlling a plurality of separate switches.

BACKGROUND OF THE INVENTION

In keyboard applications, for example in conjunction with word processor equipment or home and professional computers which use a display, there is a need to control the position of a cursor on the display in both the vertical and horizontal directions. Since there are four directions (up, down, left and right), there is a requirement to control four separate switches to properly locate the cursor where desired.

Various prior art switch techniques have been utilized to accomplish this four-way switching operation. One such method of controlling the switches uses four separate keys of the same type used for other functions on the keyboard and often involves a separation (such as by the "space bar") between the vertical control switches and the horizontal control switches. Also the vertical up and down controls (as well as the horizontal left and right controls) are often located side by side which means the user must specifically look at the key for the up or down (or left-right) symbol to ensure the correct key is being depressed.

Another method uses a separate set of keys oriented to coincide with the direction each key will move the cursor This is a better system but also involves four separate keys and requires lifting of the finger from key to key. Also, for both of the previous methods the keys will "wobble" if tolerances are not tightly controlled.

SUMMARY OF THE INVENTION

The present invention described and disclosed herein comprises a four-way integral switch mechanism for allowing activation of any one of four switches. In the preferred embodiment, the mechanism is used to position a cursor on a display in both the vertical and horizontal directions where there is a need to control four separate switches to properly locate the cursor.

The switch mechanism comprises a first switch topper for controlling the motion of the cursor along a first axis and a second switch topper for controlling the movement of the cursor along a second axis 90 degrees from the first axis. In the preferred embodiment, the second switch topper is designed to snap into and to be pivotable within the first switch topper along a vertical axis. The two switch toppers are then snapped into a base which provides a horizontal pivot axis. The base includes a plurality of guide pin holes for positioning it and the switch toppers within a switch assembly housing. A spring mechanism is positioned between the base and the switch assembly housing and engages each of the four lower surfaces of the switch toppers. Electrical switches are positioned below apertures located in the switch assembly housing and are operable when activated to cause the cursor to move in a selected direction.

BRIEF DESCRIPTION OF THE DRAWINGS

Other objects and features of the invention will become more readily understood from the following detailed description and appended claims when read in conjunction with the accompanying drawings, in which like reference numerals designate like parts throughout the figures thereof, and in which:

DETAILED DESCRIPTION OF THE INVENTION

Figure 1:
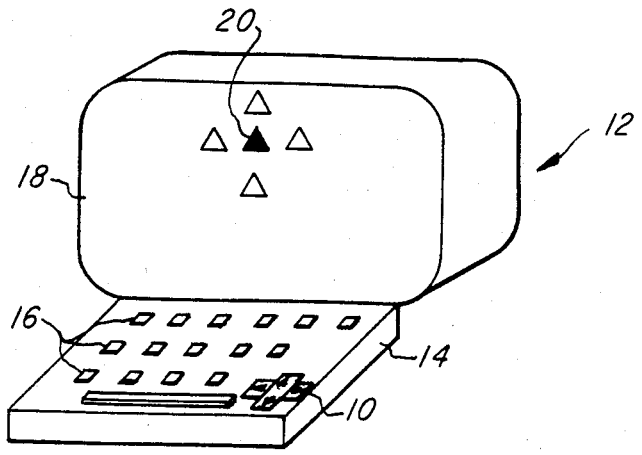
FIG. 1 illustrates a computer system utilizing the key switch assembly according to the present invention.

Referring now to FIG. 1 there is illustrated a key switch assembly 10 constructed according to the present invention and included in a computer system 12. Switch assembly 10 is physically positioned in a keyboard housing 14 which also includes a plurality of additional keys 16. A display 18 is used to view the data stored in computer system 12. Computer system 12 may be a word processor, home or professional computer or other digital system which utilizes a cursor; however, the key switch assembly may be used in any application where there is a need to activate a plurality of switches, such as a plotter, a robot arm, etc. A cursor 20 is illustrated on display 18 and is moved horizontally (left and right) as well as vertically (up and down). The movement of cursor 20 is accomplished by an operator applying finger pressure in the appropriate direction to key switch assembly 10. Switch assembly 10, therefore, in the preferred embodiment is a four-way switch key capable of actuating a plurality of electrical switches 98–104 (shown in FIGS. 2, 4 and 5.

Figure 3:
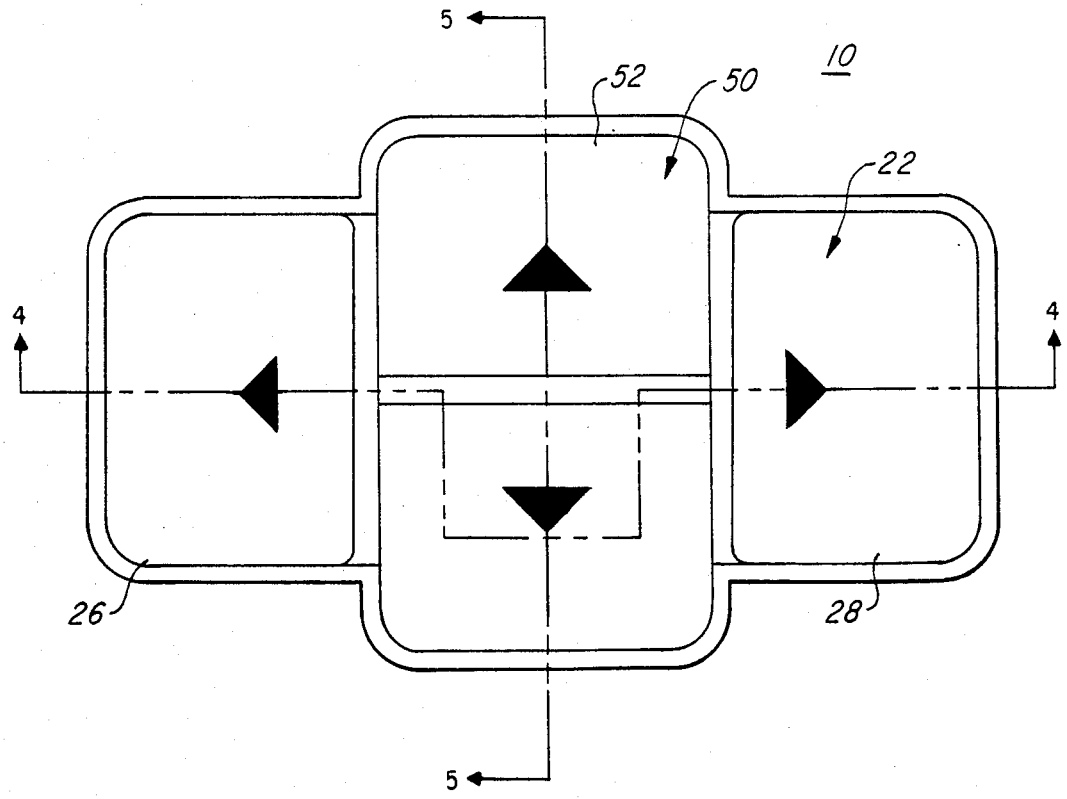
FIG. 3 is a top view of the key switch assembly constructed according to the present invention.
Figure 2:
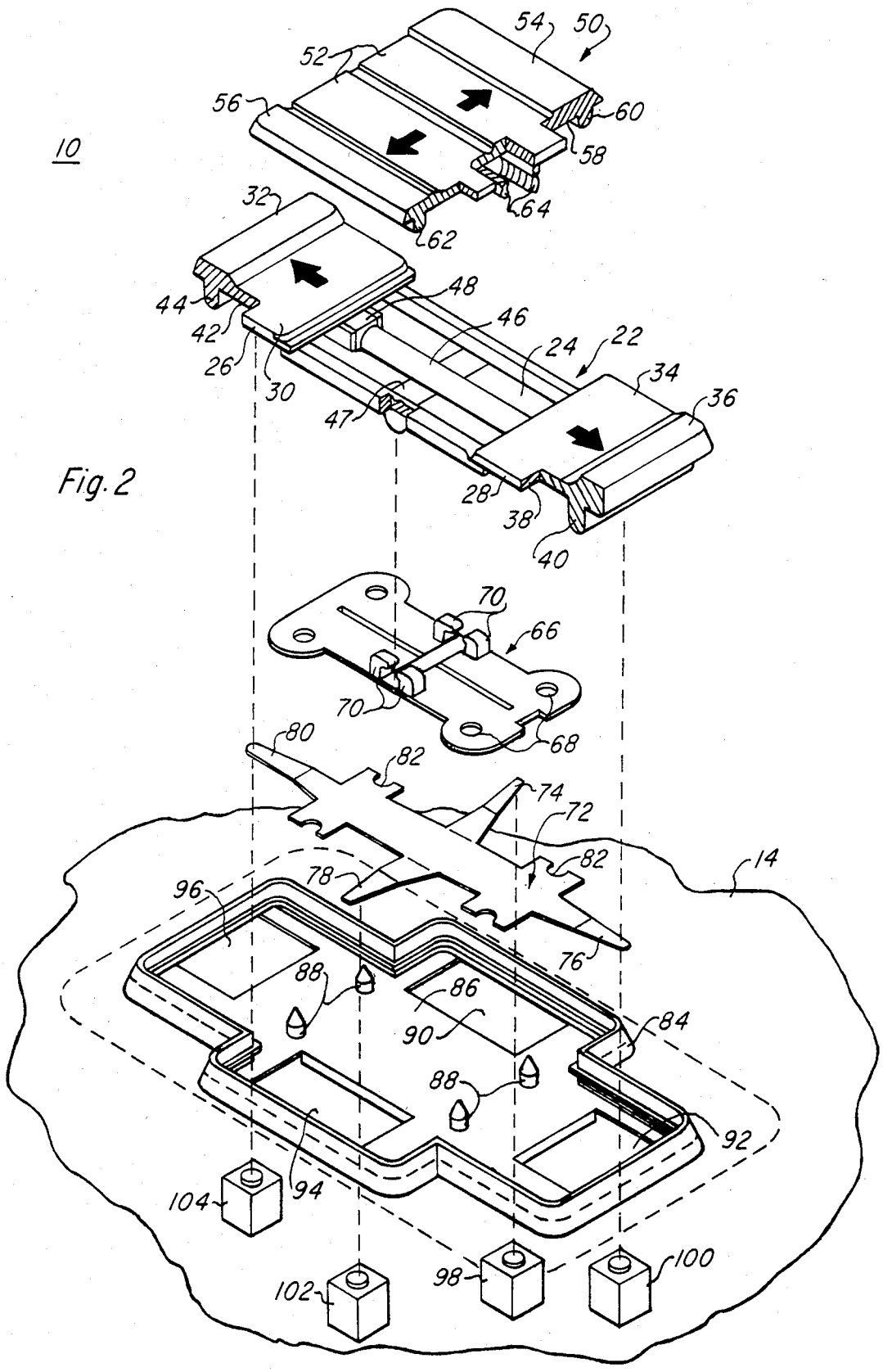
FIG. 2 is an exploded perspective view of the four-way switch key assembly constructed according to the present invention.
Figure 4:
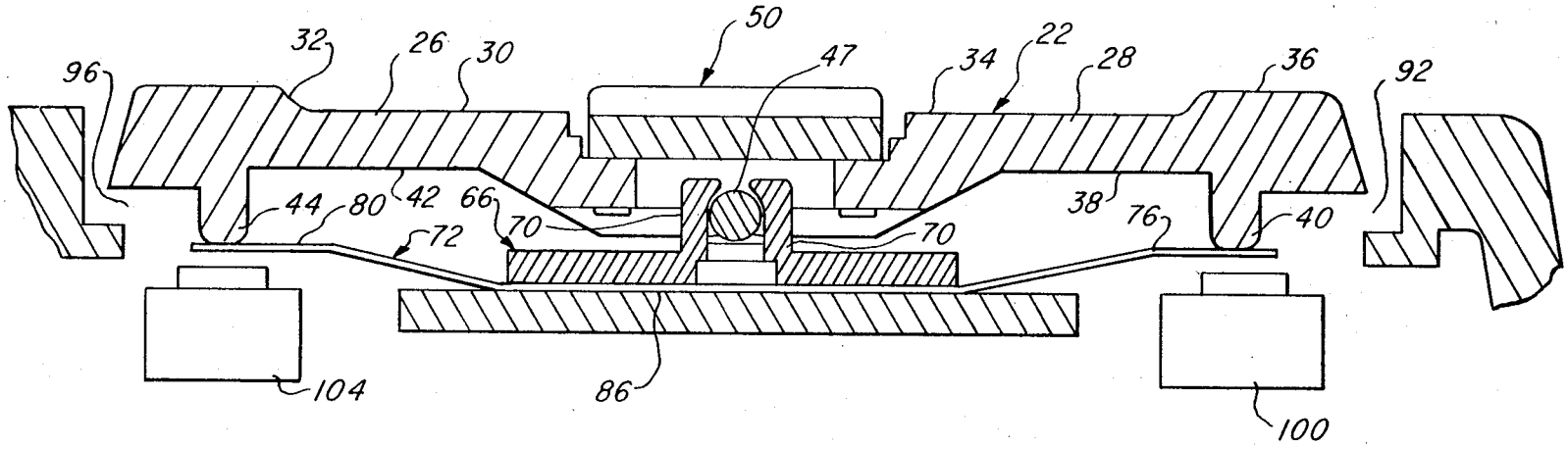
FIG. 4 is a sectional view of FIG. 3 taken along section lines 4—4.
Figure 5:
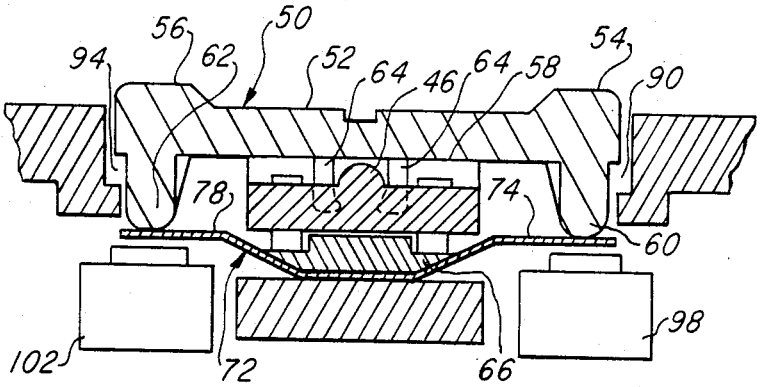
FIG. 5 is a section view of FIG. 3 taken along section lines 5—5.

FIG. 2 illustrates an exploded perspective view of the key switch assembly 10 illustrated in FIG. 1. More detailed top and cross sectional views are illustrated in FIGS. 3–5 and should also be referred to during the following discussion.

A first switch topper 22 is illustrated which controls the left-right motion (horizontal—shown in dotted lines) of cursor 20 (FIG. 1). Topper 22 has an opening 24 therein which divides topper 22 into two portions 26 and 28. Portion 26 of topper 22 moves the cursor 20 to the left while portion 28 when depressed by an operator moves cursor 20 to the right. The upper surface 30 of portion 26 has a raised portion 32 while the upper surface 34 has a raised portion 36. These raised portions 32 and 36 are for aiding an operator in depressing the topper to the left or to the right. The lower surface 38 of portion 28 includes a protuberance 40 which is used in depressing an electrical switch 100. In a similar manner, the lower surface 42 of portion 26 of topper 22 includes another protuberance 44, also utilized for depressing an electrical switch 104 which moves the cursor to the left.

A first pivot element 46 is positioned underneath the lower surfaces 38 and 42 of topper 22 and is held in place by support member 48. A second pivot element 47 is positioned underneath first pivot element 46. In a preferred embodiment, first and second pivot elements 46 and 47 are positioned at 90 degrees with respect to one another and are each generally circular in construction.

A second switch topper 50 controls the vertical motion (up-down and shown in dotted lines in FIG. 1) of cursor 20. Topper 50 has an upper surface 52 having raised portions 54 and 56. The lower surface 58 has a protuberance 60 and 62 which, when depressed, activates switches 98 and 102 which raises or lowers the cursor 20 on display 18. Located generally in the center portion of the lower surface 58 is a pivot assembly 64, which in the preferred embodiment, is a pivot snap assembly. When assemblying the first and second toppers 22 and 50, topper 50 is positioned into opening 24 and the pivot assembly 64 encircles and snaps around first pivot element 46. This arrangement and cooperation between topper 50 and 22 allows topper 50 to rotate or move in a first direction around pivot element 46.

The third element of key switch assembly 10 is the base 66 which is a generally flat member having an alignment element, such as guide holes 68 therein. These guide holes 68 are used in the positioning of the key switch assembly 10 in keyboard housing 14 (FIG. 1). Located in the central portion of base 66 is a pivot assembly 70 which (like assembly 64) in the preferred embodiment is a pivot snap assembly. In assembling the key switch assembly 10, topper 22 is positioned into base 66 by having the pivot assembly 70 encircle second pivot element 47. In the preferred embodiment, pivot element 47 snaps into pivot assembly 70. In this manner, topper 22 is allowed to rotate or pivot about pivot element 47 which thereby allows rotation in one direction to position cursor 20 either in the left or right direction. In the preferred embodiment, the base member 66 therefor provides a pivot axis which is 90 degrees spaced from the pivot assembly 64.

A spring means 72 has four spring arms 74, 76, 78 and 80 which engage protuberances 60, 40, 62 and 44, respectively. This can be seen more clearly in FIGS. 4 and 5. By having spring arms 74–80 apply upward pressure to toppers 22 and 50, the switch toppers are urged into contacting relationship so that a tight fit is maintained between switch toppers 22 and 50 to thus provide a tactile feel to the switch which is more pleasing to the operator. Spring means 72 also includes alignment or guide means 82 for properly aligning spring means 72 in the keyboard housing 14. The feel of the switch can be adjusted by changing the thickness of the spring, or the type of spring metal used or the shape of the arms. Typical metals which can be used for the spring means 72 are stainless steel or beryllium copper, by way of example. Spring means 72 is positioned between base means 66 and switch assembly housing 84.

Switch assembly housing 84 is a part of the keyboard housing 14 and is the receptacle for the spring means 72, base means 66 and toppers 22 and 50. Switch assembly housing 84 is comprised of a central portion 86 which provides the support for the toppers 22 and 50, base means 66 and spring means 72. An alignment means 88, which in the preferred embodiment are guide pins, aligns the spring means 72 by aligning the guide means 82 with guide pins 88. The guide holes 68 in base 66 are positioned over and fit onto guide pins 88. Through the use of ultrasonic welding, spring 72 and base 66 are permanently attached to switch assembly housing 84. Switch arms 74, 76, 78 and 80 are positioned over apertures 92, 94, 96 and 98, respectively. Beneath each of these apertures are electrical switches 98, 100, 102 and 104 which cause the cursor to move up, right, down and left, respectively.

FIGS. 3–5 illustrate the key switch assembly 10 coupled together. As can be seen from FIG. 3, switch assembly 10 is an integral unit which allows an operator without removing his finger from the key to move the cursor in all four directions up, down, left and right. In other words, the operator does not have to search for the proper key but can operate the cursor strictly by feel utilizing essentially one key switch assembly. By moving his finger to the upper surface 26 of topper 22, topper 22 will rotate about pivot axis 47, pushing protuberance 44 against spring arm 80 and against the top of switch 104 thereby activating such switch and moving the cursor 20 on display 18 to the left; protuberance 44 is moved through aperture 96 (FIG. 4). In like manner, when an operator applies pressure to the upper surface 52 of topper 50 (FIGS. 3 and 5), topper 50 will rotate about pivot axis 46 thereby moving protuberance 60 downward against spring arm 74 and actuate electrical switch 98 which causes cursor 20 on display 18 to move upward.

The four-way key switch control mechanism according to the present invention is made from two switch toppers, one of which snaps into and pivots within the other. These two toppers then snap into a base element which provides a pivot axis 90 degrees from the first axis. In this manner, two topper assemblies form one integral whole which provides control of four switches by sliding the finger in the direction that cursor movement is desired. Each key has but one degree of freedom, that of rotation, which gives the keys a firm controlled feel. This provides technical advantages such as, for example, because of the snap-together feature and because of the single axis of rotation. The spring mechanism, good tactile feedback to the operator and good feel of the key switch gives a quality performance to the operator which is very important in a digital system since the cursor control is a primary point of interaction between the operator and the computer system.

Although the present invention has been shown and illustrated in terms of a specific apparatus, it will be apparent that changes or modifications can be made without departing from the spirit and scope of the invention as defined by the appended claims.

What is claimed is:

1. A four-way switch comprising:

a switch key having:

a first switch topper having an upper and lower surface and an opening centrally located therein, said first switch topper also having a first and second pivot element positioned underneath said lower surface, said first and second pivot elements mounted at 90° to one another;

a second switch topper having an upper and lower surface adapted to be positioned in the opening of said first switch topper so that the upper surfaces of said first and and second switch toppers are substantially flush with one another, said second switch topper having a pivot assembly on its lower surface adapted to engage said first pivot element in said first switch topper to thereby pivotably secure said second switch topper to said first switch topper to allow movement of said second switch topper along a first axis only, and base means having a pivot assembly thereon adapted to engage said second pivot element on said first switch topper to thereby pivotably secure said first switch topper to said base to allow movement of said first switch topper along a second axis which is 90° from said first axis;

protuberances located on the bottom surfaces of said first and second switch toppers at the terminal ends thereof; and spring means engaging each of the protuberances of said first and second switch toppers;

a housing for accommodating said switch key, said housing having four apertures located therein around the periphery of said housing, said housing also comprising alignment means for positioning said switch key within said housing so that each of said protuberances is located directly above one of said apertures; and electrical switch means located below each of said apertures so that when an operator selectively pushes on the upper surface of either of the first and second switch toppers at the location of one of the protuberances, the electrical switch means located beneath the selected protuberance is activated.

2. The four-way switch of claim 1 wherein said second switch topper pivot assembly and said base means pivot assembly are pivot snap assemblies.

3. The four-way switch of claim 1 wherein the alignment means of said housing comprises guide pins located on the top surface thereof and said spring means is a unitary structure having four arms for engaging the four ends of the bottom surfaces of said first and second switch toppers and means for engaging said guide pins and said base means has holes therein for fitting through said guide pins.

4. An apparatus for controlling a cursor in a digital system including:

a display having said cursor thereon the improvement comprising;

a keyboard housing having a plurality of keys thereon including a cursor switch housing;

a four-way cursor switch key for being disposed within said cursor switch housing, said cursor switch key comprising:

a first switch topper having an upper and lower surface and an opening centrally located therein, said first switch topper also having a first and second pivot element positioned underneath said lower surface, said first and second pivot elements mounted at 90° to one another;

a second switch topper having an upper and lower surface adapted to be positioned in the opening of said first switch topper so that the upper surfaces of said first and second switch toppers are substantially flush with one another, said second switch topper having a pivot assembly on its lower surface adapted to engage said first pivot element in said first switch topper to thereby pivotably secure said second switch topper to said first switch topper to allow movement of said second switch topper along a first axis only, and base means having a pivot assembly thereon adapted to engage said second pivot element on said first switch topper to thereby pivotably secure said first switch topper to said base to allow movement of said first switch topper along a second axis which is 90° from said first axis;

protuberances located on the bottom surfaces of said first and second switch toppers at the terminal ends thereof; and spring means engaging each of the protuberances of said first and second switch toppers;

said cursor switch housing having four apertures located therein around the periphery of said housing and also comprising alignment means for positioning said cursor switch key within said housing so that each of said protuberances is located directly above one of said apertures; and a plurality of switches positioned beneath each of said apertures so that when an operator selectively pushes on the upper surface of either of said first and second switch toppers at one end thereof, the switch located beneath the selected end of the switch topper is activated to cause movement of the cursor on the display.

5. An apparatus according to claim 4 wherein said second switch topper pivot assembly and said base means pivot assembly are pivot snap assemblies.

6. An apparatus according to claim 4 wherein said spring means is a unitary structure having four arms for engaging the four ends of the bottom surfaces of said first and second switch toppers.

* * * * *